United States Patent [19]

Holloway

[11] Patent Number: 5,018,893

[45] Date of Patent: May 28, 1991

[54] COSMETIC STICK DISPENSER

[76] Inventor: Thomas F. Holloway, 866 Peter Rd., Southbury, Conn. 06488

[21] Appl. No.: 501,024

[22] Filed: Mar. 29, 1990

[51] Int. Cl.[5] ..... A45D 40/06

[52] U.S. Cl. ..... 401/75; 401/175

[58] Field of Search ..... 401/75, 175, 68, 70, 401/76, 174

[56] References Cited

U.S. PATENT DOCUMENTS

| | | | |
|---|---|---|---|
| 3,256,980 | 6/1966 | Bau | 401/75 |
| 3,275,132 | 9/1966 | Hultgren | 401/76 X |
| 3,807,881 | 4/1974 | Seidler | 401/175 |

FOREIGN PATENT DOCUMENTS

| | | | |
|---|---|---|---|
| 1351560 | 12/1963 | France | 401/75 |

*Primary Examiner*—Richard J. Johnson

*Attorney, Agent, or Firm*—St. Onge Steward Johnston & Reens

[57] ABSTRACT

A dispenser comprises a hollow base member, and a hollow nose member, the inner wall of which is non-circular in cross-sectional shape. The nose member and base member snap fit together. A base insert fits into the base member. The base insert is sized to be retained in the base member between a shoulder on the inner wall of the base member and the lower end of the nose member when the nose member and base member are secured together. The base insert is internally screw threaded. An elevator having a screw threaded stem adapted to screw together with the base insert has an axially movable platform which is operated by rotation of the base member relative to the nose member to dispense a stick product contained in the nose member.

3 Claims, 2 Drawing Sheets

COSMETIC STICK DISPENSER

FIELD OF THE INVENTION:

The present invention relates to a stick dispenser used in packaging of cosmetic stick products such as lipstick.

BACKGROUND OF THE INVENTION

Stick dispensers for cosmetic stick products such as lipstick have in the past been used to dispense relatively large diameter cylindrical stick products having a diameter in the range of about 7/16 inches. Recently however, there has been a trend to slimmer stick products and dispensers with a more aesthetic profile. It would be desirable to be able to dispense products having a ¼ inch or less maximum diameter. However, the construction of slimmer dispensers presents difficulties which differ from prior large diameter dispensers. In particular, the small diameter of such slimmer dispensers limits the available space for providing a twist-up elevator mechanism to move the stick product up and down in the dispenser barrel.

In addition, a slimmer stick product is more fragile than a larger diameter stick product, making it difficult to remove the stick from a separate mold and transfer it to the dispenser.

SUMMARY OF THE INVENTION

It is an object of the invention to provide a slim stick dispenser that allows a twist-up dispensing of the stick product. It is a further object of the invention to provide a dispenser that may be filled with a molten cosmetic stick product which is molded in place. It is a further object of the invention to provide a dispenser which is economical and simple to assemble.

A dispenser in accordance with the invention comprises a hollow base member and a hollow nose member, the inner wall of which has a cross-sectional shape which prevents rotation of a conforming platform movable axially therein. Preferably the cross-sectional shape is non-circular. More preferably the inner wall is polygonal and most preferably it is octagonal in cross-sectional shape. The nose member and base member have mutually engaging means for securing them together, which preferably comprise an annular rib formed on one of the base member and nose member and an annular channel formed on the other of said base member and nose member. The rib snap fits into the channel.

A base insert fits into the base member. The base insert is sized to be retained in the base member between a shoulder on the inner wall of the base member and the lower end of the nose member when the nose member and base member are secured together. The base insert is preferably provided with a plurality of rib sections for frictional interengagement of the base insert with the inner wall of the base member. The base insert is internally screw threaded and preferably comprises a metal screw. Most preferably, the base insert internal screw threads are left hand threaded.

An elevator having a screw threaded stem adapted to screw together with said base insert, and a platform adapted to slidingly fit inside said nose member provide the dispensing mechanism. The platform has a cross-sectional shape which conforms with the cross-sectional shape of the inner wall of the nose member to prevent rotation of the platform as it moves axially in the dispenser.

The elevator stem has a length sufficient to allow the elevator platform to axially travel from a retracted position with the platform adjacent the base insert to an extended position with the platform adjacent the upper open end of the nose member.

A hollow cap, open at one end, which is sized and adapted to surround said nose member, is frictionally mounted on the outer wall of the upper end of the base member.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 1:
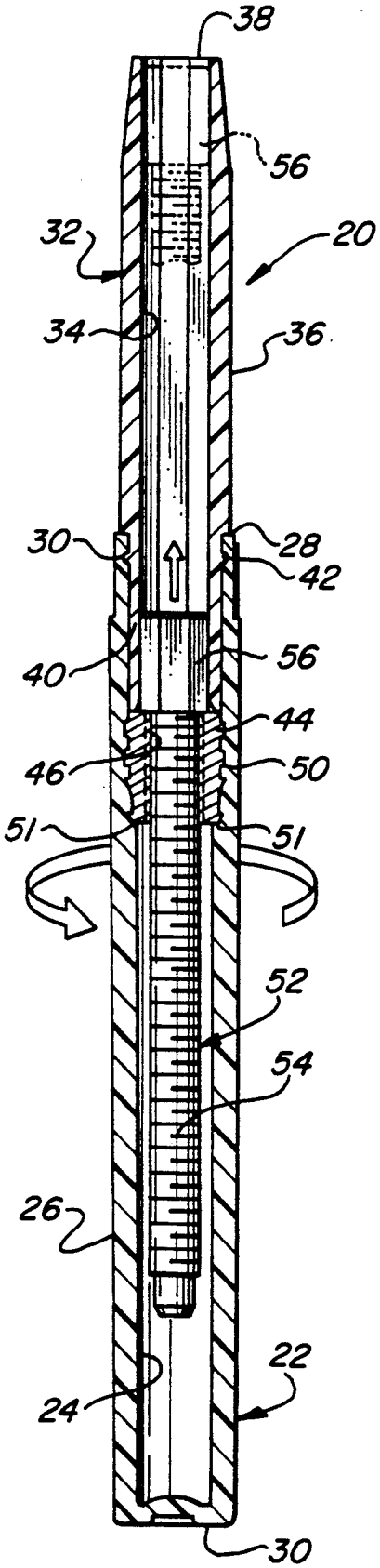
FIG. 1 is a cross-sectional view of a stick dispenser in accordance with the invention.
Figures 2, 3:
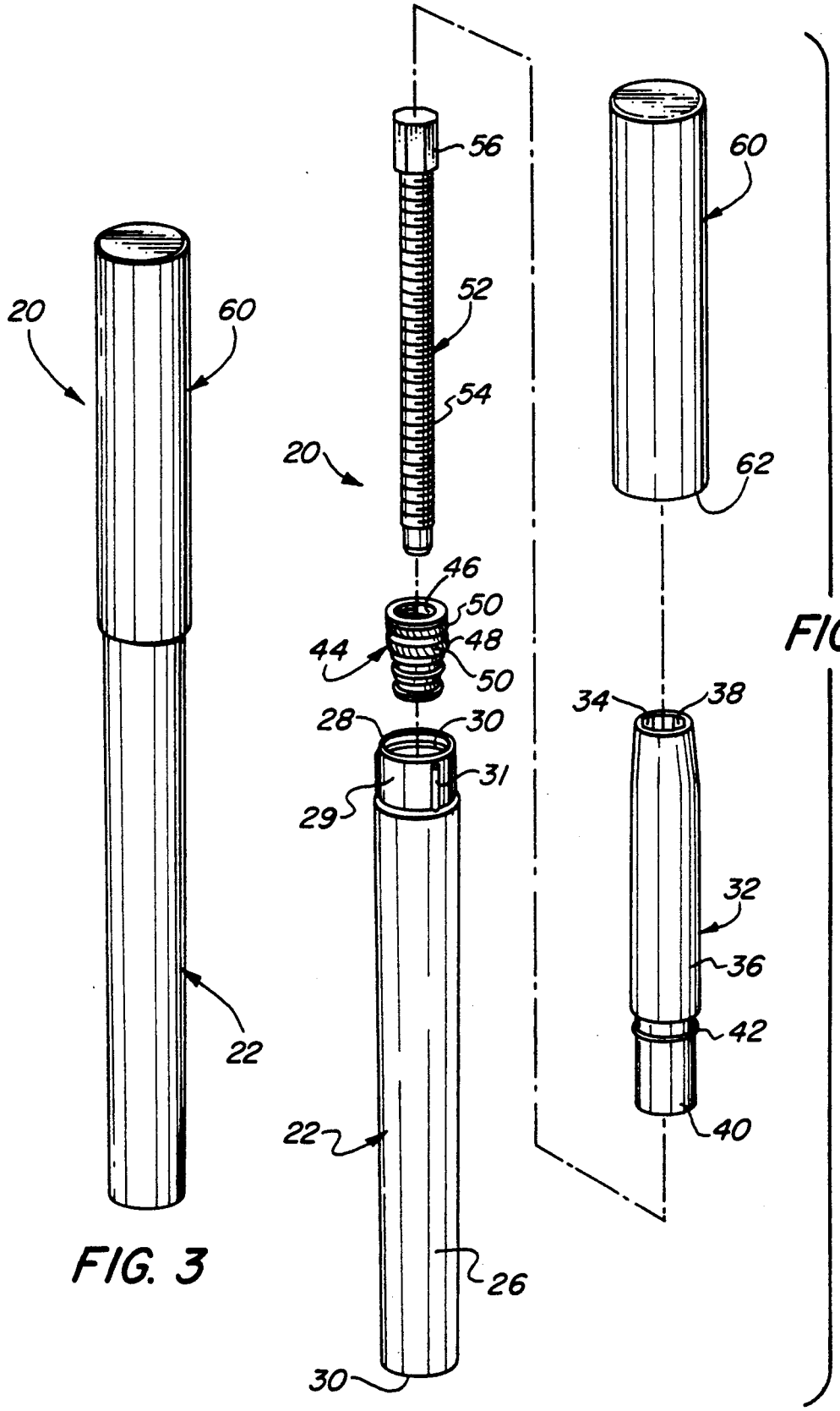
FIG. 2 is an exploded perspective view of the dispenser of FIG. 1.
FIG. 3 is a perspective view of an assembled dispenser.

Referring now to FIGS. 1 and 2, a stick dispenser is shown generally at 20.

A hollow base member 22 having an inner wall 24 and an outer wall 26. Base member 22 has an open upper end 28 and a closed lower end 30. Base member 22 is generally circular in cross-section. Upper end 28 has an annular channel 30 formed in the inner wall 24.

A hollow nose member 32 has an inner wall 34 and an outer wall 36. Nose member 32 has an open upper end 38 and an open lower end 40. Inner wall 34 of the nose member 32 is of a predetermined shape to prevent rotation of a platform 56 which is axially movable therein. Preferably, the inner wall 34 is non-circular in cross-section, and is preferably polygonal. In the most preferred embodiment, inner wall 34 is octagonal in cross-sectional shape. The lower end 40 of nose member 32 is sized to be received inside the upper end 28 of base member 22.

The base member 22 and nose member 32 have mutually engaging means for securing the members together. In a preferred embodiment, the lower end 40 of the nose member 32 has a radially extending rib 42 for snap fitting in annular channel 30 of the base member 22 when the base member 22 and nose member 32 are assembled together.

A base insert 44 is mounted in the base member 22 adjacent where the lower end 40 of nose member 32 is located when the nose and base members 32 and 22 are assembled together. The base insert 44 has an inner wall 46 and an outer wall 48. Inner wall 46 is internally screw threaded. Preferably, the inner wall 46 is internally left hand screw threaded so that a stick product may be dispensed from the dispenser by clockwise rotation of the base member 22 relative to the nose member 32. Outer wall 48 of base insert 44 has a plurality of rib segments 50 thereon for engaging the inner wall 24 of base member 22. Most preferably, base insert 44 is a metal knurled screw.

Means for retaining the base insert 44 in the base member 22 are provided, and in one preferred embodiment comprise a shoulder 51 formed inside the base member 22 which acts together with and the lower end 40 of nose member 32. The shoulder 51 and lower end 40 trap and retain the base insert 44 in the base member when the base member 22 and nose member 32 are snapped together.

An elevator 52 has a screw threaded stem 54 adapted to screw together with the base insert 44 and a platform 56 adapted to slidingly fit inside the nose member 32. The platform 56 has a cross-sectional shape which corresponds to the cross-sectional shape of the inner wall 34 of the nose member 32. Stem 54 has a length sufficient to allow the platform 56 axial travel from a retracted position adjacent the base insert 44 to an extended position adjacent the upper open end 38 of nose member 32, as shown in FIG. 1.

The preferred embodiment of the dispenser 20 is operable to dispense a stick product contained in the nose member 32 by clockwise rotation of the base member 22 relative to the nose member 32. The clockwise rotation causes the platform 56 to move axially towards the upper open end 38 of nose member 32. Counterclockwise rotation will cause the platform 56 to move axially away from the upper open end 38 of nose member 32 and axially towards the base insert 44.

A hollow cap 60 is open at one end 62. Cap 60 is sized and adapted to surround the nose member 32 and frictionally mounts on the outer wall 29 of the upper end 28 of the base member 22. Preferably ribs 31 are provided on upper wall 29 to improve the friction mount.

The foregoing parts of the dispenser or the invention are preferably manufactured by injection molding from polymeric materials. As previously mentioned however, the base insert 44 is preferably a metal part.

The steps of assembling the dispenser or the invention are generally as follows. The base insert 44 is mounted on the stem 54. If desired, the end of stem 54 opposite platform 56 may be deformed to retain the elevator 52 in base insert 44. The elevator 52 and base insert 44 are both placed into the base member 22. The nose member 32 is then aligned with the perimeter of the platform 56 and it is secured together with the base member 22 and retains the base insert 44 in place.

It is to be appreciated that the dispenser of the invention permits the filling of the nose member 32 prior to assembly with the base member 22. The nose member would be filled with molten stick product through its bottom end 40 or upper end 38. After the stick product solidifies, the nose member 32 would be secured together with the base member 22 and elevator 52. Alternatively, it is also possible to separately mold the stick product and insert it into nose member 32 after it solidifies. The solid stick product may be inserted into the bottom end 40 of nose member 32 prior to assembly with the base member 22. The solid stick product may also be inserted into the upper end 38 of nose member 32 either prior to or after assembly of the nose member 32 with the base member 22.

The invention of the application provides a new and useful dispenser having a slim profile, and also provides a substantial ease and flexibility in the manufacturing and packaging of a stick product such as lipstick.

I claim:

1. A stick dispenser comprising:

a hollow base member having an inner wall and an outer wall and an open upper end and a closed lower end, said upper end having an annular channel formed therein and a radially inward extending shoulder below said channel;

a hollow nose member having an inner wall and an outer wall and open upper and lower ends, the inner wall of said nose member being polygonal in cross-sectional shape, said lower end of said nose member being sized to be received inside said base member, said lower end of said nose member having a radially extending rib for snap fit in said annular channel in said base member to secure said nose and base members together;

a metal base insert, said base insert being fixedly retained in said base member between said shoulder and said lower end of said nose member when said nose member and base member are secured together, and having an outer wall with a plurality of rib segments thereon for engaging said inner wall of said base member, and being internally left hand screw threaded;

an elevator, said elevator having a platform adapted to slidingly fit inside said nose member, said platform having a cross-sectional shape which conforms to the cross-sectional shape of said nose member inner wall, and a screw threaded stem adapted to screw together with said base insert, said stem having a length sufficient to allow said elevator platform to be axially moved from a retracted position wherein said platform is adjacent said base insert to an extended position wherein said platform adjacent the upper open end of said nose member;

said dispenser being operable to dispense a stick product from said nose member by clockwise rotation of said base member relative to said nose member.

2. A stick dispenser in accordance with claim 1, further comprising a hollow cap open at one end, said cap being sized and adapted to surround said nose member, said cap open end being sized and adapted to frictionally mount on the outer wall of said upper end of said base member.

3. A stick dispenser in accordance with claim 1, wherein said inner wall of said nose member and said elevator platform are generally octagonal in cross-section.

* * * * *